US009890522B2

(12) United States Patent
Homami et al.

(10) Patent No.: US 9,890,522 B2
(45) Date of Patent: Feb. 13, 2018

(54) ADJUSTABLE OVERFLOW CLOSURE DEVICE WITH CABLE DRAIN

(71) Applicants: Max Homami, Los Angeles, CA (US); Michael Gerard Rohlfs, Los Angeles, CA (US)

(72) Inventors: Max Homami, Los Angeles, CA (US); Michael Gerard Rohlfs, Los Angeles, CA (US)

( * ) Notice: Subject to any disclaimer, the term of this patent is extended or adjusted under 35 U.S.C. 154(b) by 104 days.

(21) Appl. No.: 14/626,930

(22) Filed: Feb. 20, 2015

(65) Prior Publication Data

US 2015/0159355 A1 Jun. 11, 2015

Related U.S. Application Data

(63) Continuation-in-part of application No. 14/137,958, filed on Dec. 20, 2013, now Pat. No. 9,157,222, which is a continuation of application No. 13/563,666, filed on Jul. 31, 2012, now Pat. No. 8,635,719.

(60) Provisional application No. 61/942,607, filed on Feb. 20, 2014, provisional application No. 61/514,340, filed on Aug. 2, 2011.

(51) Int. Cl.
*E03C 1/244* (2006.01)
*E03C 1/12* (2006.01)
*E03C 1/24* (2006.01)

(52) U.S. Cl.
CPC ..... *E03C 1/24* (2013.01); *E03C 1/244* (2013.01); *E03C 2001/2406* (2013.01); *Y10T 137/86863* (2015.04)

(58) Field of Classification Search
CPC .... E03C 1/232; E03C 1/24; E03C 2001/2413; E03C 1/244
USPC ..... 4/694
See application file for complete search history.

(56) References Cited

U.S. PATENT DOCUMENTS 1,281,222 A * 10/1918 Stepanchak ..... E03C 1/24 4/694
3,559,634 A 2/1971 Lillywhite
(Continued)

FOREIGN PATENT DOCUMENTS

EP 2703570 A1 * 3/2014 ..... E03C 1/24

OTHER PUBLICATIONS

Englsih machine translation of EP 2 703 570 A1 dated Nov. 7, 2016.*

*Primary Examiner* — Christine Skubinna
(74) *Attorney, Agent, or Firm* — Hackler Daghighian Martino & Novak

(57) ABSTRACT

An overflow drain for a tub includes a bracket configured to be located against an inside surface of the tub and connected to an overflow elbow. A first elongated slot is disposed through the bracket. A faceplate is configured to be attached to the bracket. A second elongated slot is disposed through the faceplate. A first knob is movably connected to the faceplate. An elongated seal plate is disposed on the inside of the faceplate and connected to the first knob. The seal plate is configured to move between an open position and a closed position by a movement of the first knob, wherein in the closed position the seal plate is configured to create a watertight seal around either the first or second elongated slots, and wherein in the open position the seal plate is configured to drain a fluid through the first and second elongated slots.

19 Claims, 8 Drawing Sheets

(56) References Cited

U.S. PATENT DOCUMENTS

| | | | | |
|---|---|---|---|---|
| 3,570,020 | A * | 3/1971 | Kato | E03C 1/24 4/694 |
| 3,835,484 | A | 9/1974 | Kato | |
| 3,859,676 | A * | 1/1975 | Kato | E03C 1/232 4/287 |
| 3,927,428 | A | 12/1975 | Jette et al. | |
| 4,042,984 | A | 8/1977 | Butler | |
| 4,524,798 | A | 6/1985 | Simard | |
| 4,607,658 | A | 8/1986 | Fraser et al. | |
| 4,744,108 | A | 5/1988 | Schmidt | |
| 5,123,123 | A | 6/1992 | Hart et al. | |
| 5,190,077 | A | 5/1993 | Pawelzik et al. | |
| 6,216,288 | B1 | 4/2001 | Bernau | |
| 6,732,388 | B2 | 5/2004 | McKenna | |
| 6,895,610 | B2 | 5/2005 | Olson | |
| 7,451,502 | B2 | 11/2008 | Ball | |
| 7,644,728 | B2 * | 1/2010 | Yang | F16K 11/0743 137/625.15 |
| 2016/0274602 | A1 * | 9/2016 | Peel | F17D 1/00 |

* cited by examiner

ADJUSTABLE OVERFLOW CLOSURE DEVICE WITH CABLE DRAIN

CROSS-REFERENCE TO RELATED APPLICATIONS

This non-provisional application claims priority to provisional application 61/942,607 filed on Feb. 20, 2014. Also, this non-provisional application also claims priority to application Ser. No. 14/137,958 filed on Dec. 20, 2013, which itself was a continuation application claiming priority to application Ser. No. 13/563,666 filed on Jul. 31, 2012, now U.S. Pat. No. 8,635,719 which also claimed priority to provisional application 61/514,340 filed on Aug. 2, 2011. The contents of all applications reference above are fully incorporated herein with these references.

DESCRIPTION

Field of the Invention

The present invention generally relates to overflow closure devices and overflow drains. More particularly, the present invention relates to an adjustable overflow drain that can vary the water level within a tub or sink.

Background of the Invention

A typical bathtub has a lower drain at the lowest part of the tub and an upper overflow drain mounted on a side wall near the front of the tub. The lower drain is typically used to control the amount of water located within the tub. When the lower drain is open, water can quickly exit out the lower drain. The overflow drain facilitates the water quickly leaving through the lower drain by allowing air to vent through.

When the lower drain is closed, water fills within the tub. If one was to leave the water on, the water would fill the tub and overflow the tub. To prevent this, the typical overflow drain has an opening which allows water to escape through the drainage/plumbing.

The typical overflow device is generally circular and has a water opening located at its lower most portion. A problem arises when a person wants to use the tub and allow water to fill within. It is very common for the overflow drain to prevent the water level rising to a sufficient level to make the bathing experience enjoyable. The overflow drain decreases the height of water available in the bath tub or sink. As many common tubs are as little as fourteen inches high, the amount of usable water in the tub can be as little as seven inches due to the overflow drain.

Others have attempted to solve this problem by creating plugs that can be inserted into existing overflow drains. These plugs are cumbersome, are easily lost or fall out from within the overflow drain making loud noises and risk being stepped on by the user. Also, they prevent air from escaping through the overflow device when draining a tub or sink.

Others have attempted to create cumbersome and complicated devices that allow one to control the level of water with floats, automatic switches and electronics. However, these devices are not easily incorporated into existing tub designs and are impractical for normal usage.

Others have attempted to attach snorkels to the overflow drains. The snorkels may be positioned to control the height of the water within the tub. However, these snorkels are odd in appearance and detract from the aesthetics of the tub's appearance. Also, the snorkels cannot completely seal the overflow drain completely allowing water to rise well above the snorkel.

Accordingly, there is a need for a novel adjustable overflow closure device that allows one to vary the height of the water level and even to seal the overflow completely while remaining aesthetically pleasing and functionally easy to use. The present invention fulfills these needs and provides other related advantages.

SUMMARY OF THE INVENTION

An exemplary embodiment discloses an overflow drain for a tub. A bracket is longer in dimension in a horizontal direction as compared to a vertical direction. The bracket is configured to be located against an inside surface of the tub and connected to an overflow elbow on an outside surface of the tub. A first elongated slot is disposed through the bracket along the horizontal direction. At least two fastener holes are disposed within the bracket. A faceplate is longer in dimension in the horizontal direction as compared to the vertical direction, wherein the faceplate is configured to be attached to the bracket. A second elongated slot is disposed through the faceplate along the horizontal direction. A first knob is movably connected to the faceplate disposed on the outside of the faceplate. An elongated seal plate is disposed on the inside of the faceplate. The seal plate is connected to the first knob. The seal plate is configured to move between an open position and a closed position by a movement of the first knob, wherein in the closed position the seal plate is configured to create a watertight seal around either the first or second elongated slots, and wherein in the open position the seal plate is configured to drain a fluid through the first and second elongated slots.

In other embodiments, the bracket and/or faceplate may be rectangular-shaped. The fastener holes may be countersunk.

The first knob may be either pivotably connected to the faceplate or translatably connected to the faceplate.

The first knob may be circular-shaped, square-shaped, rectangular-shaped or triangular-shaped.

A second knob may be connected to the faceplate disposed on the outside of the faceplate, wherein the second knob is either behind or ahead of the first knob. The second knob may be connected to a movable cable at a first cable end, wherein a second cable end is connected to a bottom drain. The bottom drain is configured to move between an open position and a closed position by movement of the second knob, wherein in the closed position the bottom drain is configured to create a watertight seal, and wherein in the open position the bottom drain is configured to drain the fluid.

A first seal or gasket may be disposed between the bracket and the inside surface of the tub. The first seal or gasket may include an adhesive backing.

A second seal or gasket may be attached to the elongated seal plate. The second seal or gasket may be configured to seal either the first or second elongated slot when the seal plate is in the closed position.

Another exemplary embodiment discloses an overflow drain for a tub. A bracket is longer in dimension in a horizontal direction as compared to a vertical direction, wherein the bracket is configured to be located against an inside surface of the tub and connected to an overflow elbow on an outside surface of the tub. A first elongated slot is disposed through the bracket along the horizontal direction. At least two fastener holes are disposed within the bracket. A faceplate is longer in dimension in the horizontal direction as compared to the vertical direction, wherein the faceplate is configured to be attached to the bracket. A second elongated slot is disposed through the faceplate along the horizontal direction. A first knob is pivotably connected to the faceplate disposed on the outside of the faceplate. An elongated seal plate is disposed on the inside of the faceplate, the seal plate connected to the first knob. The seal plate is configured to move between an open position and a closed position by a movement of the first knob, wherein in the closed position the seal plate is configured to create a watertight seal around either the first or second elongated slots, and wherein in the open position the seal plate is configured to not drain a fluid through the first and second elongated slots. A second knob is pivotably connected to the faceplate disposed on the outside of the faceplate, wherein the second knob is either behind or ahead of the first knob. The second knob is connected to a movable cable at a first cable end, wherein a second cable end is connected to a bottom drain in a bottom of the tub. The bottom drain is configured to move between an open position and a closed position by movement of the second knob, wherein in the closed position the bottom drain is configured to create a watertight seal, and wherein in the open position the bottom drain is configured to drain the fluid.

Another exemplary embodiment discloses a water-level adjustable overflow drain. A first outer dial is cylindrical in shape and includes a circular center plate disposed inside the first outer dial and includes an overflow aperture in the circular center plate. A circular back plate includes a lower and upper aperture, the circular back plate configured to be attachable to an inside surface of a tub or sink. The circular center plate is sealed and rotatable relative to the circular back plate, where the overflow aperture can be rotated to align with either the lower aperture, the upper aperture or neither aperture. A stationary circular cover plate is disposed within the first outer dial and attached to the circular back plate forming an annular gap between the circular cover plate and the outer dial. A second outer dial is cylindrical in shape, the second outer dial disposed either ahead of or behind the first outer dial, wherein the second outer dial is pivotable relative to the circular back plate. An overflow elbow is configured to be disposed on an outside surface of the tub or sink connectable to the circular back plate. The second outer dial is connectable to a movable cable at a first cable end, wherein a second cable end is connectable to a bottom drain disposed in a bottom of the tub or sink. The bottom drain is configured to move between an open position and a closed position by rotation of the second outer dial, wherein in the closed position the bottom drain is configured to create a watertight seal, and wherein in the open position the bottom drain is configured to drain a fluid in the tub or sink.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
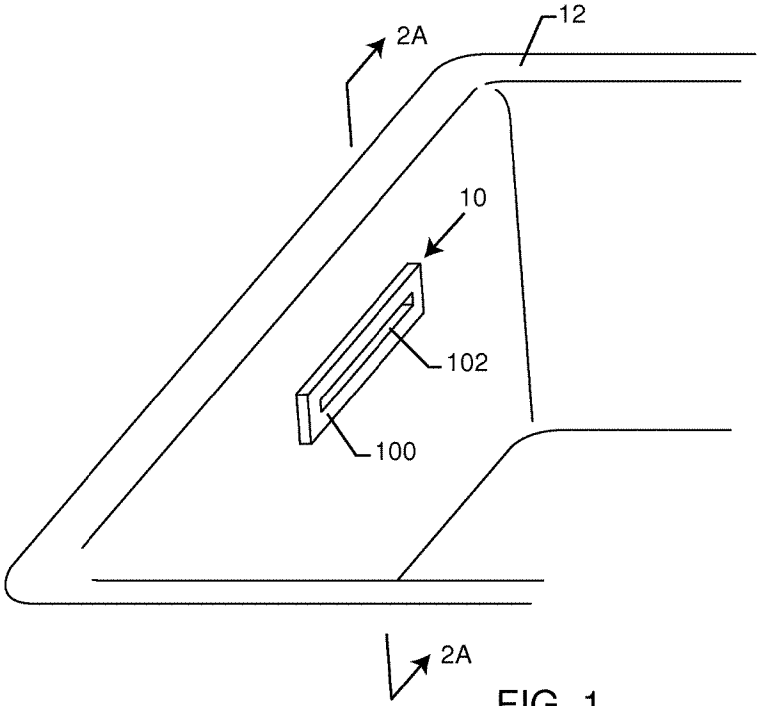
FIG. 1 is a perspective view of an exemplary adjustable overflow closure device.

FIG. 1 is a perspective view of an exemplary adjustable overflow closure device 10. FIG. 1 of the present invention is very similar to FIG. 1 of U.S. Pat. No. 8,635,719 where the overflow drain 10 was mounted to an inside surface of a tub 12 and the overflow elbow 14 was shown in dashed lines on the outside surface of the tub 12. In contrast to FIG. 1 of the '719 patent, here the overflow closure device 10 takes on a rectangular-shaped faceplate 100 with a horizontal slot 102. The industry has moved towards a very sleek and simplistic design for the various faucets and drains. Here, a rectangular-shaped faceplate 100 provides an aesthetically pleasing shape and design. The faceplate 100 and bracket 112 are longer in dimension 144 in a horizontal direction as compared to a dimension 146 in a vertical direction.

Figure 2A:
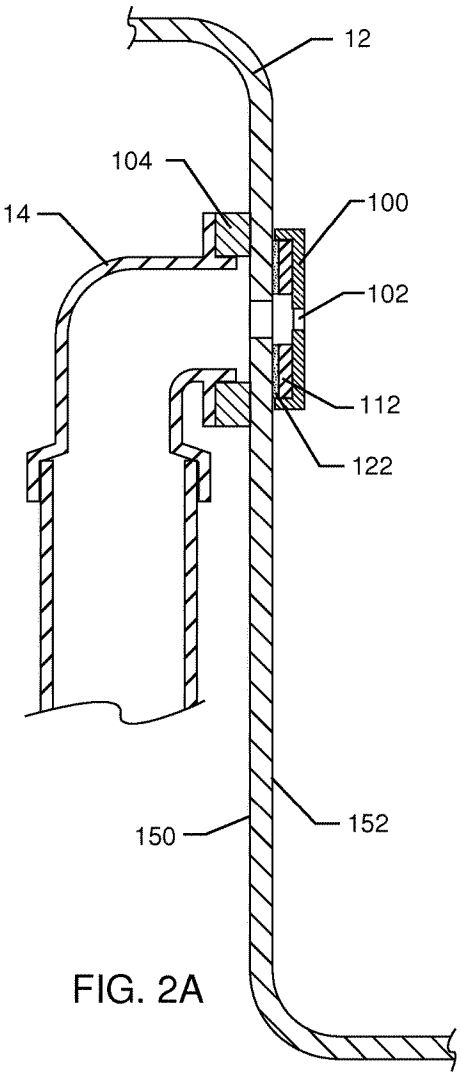
FIG. 2A is a cross-sectional view taken along the lines 2A-2A from the structure of FIG. 1.
Figure 2:
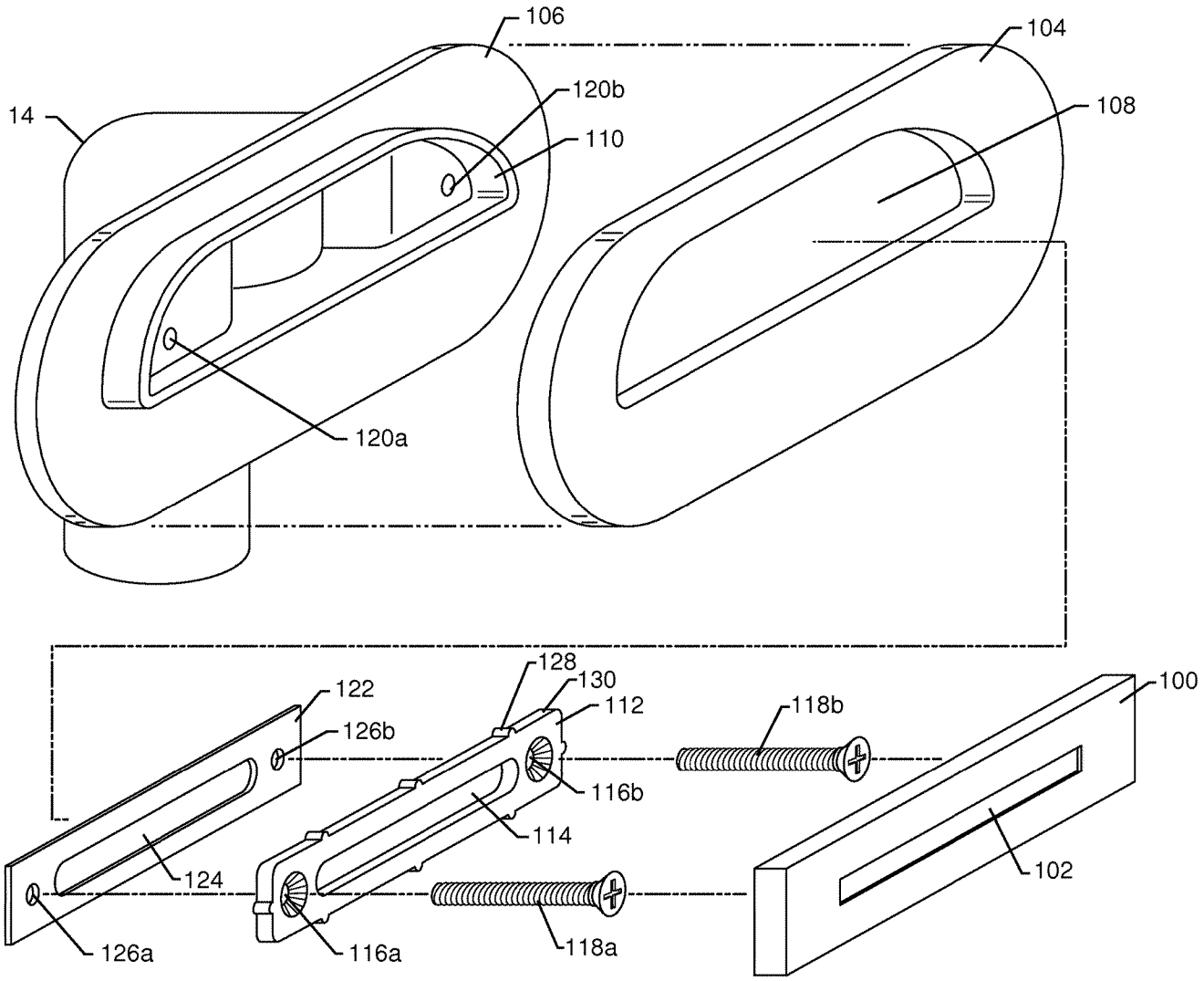
FIG. 2 is an exploded perspective view of the structure shown in FIG. 1.

FIG. 2 is an exploded perspective view of the structure 10 shown in FIG. 1. The overflow elbow 14 has a seal/gasket 104 that is used to create a watertight seal between the overflow elbow 14 and the outside surface 150 of the tub 12. The overflow elbow 14 has a flange 106 that extends outward along the surface of the wall of the tub 12. The large flange 106 helps to create a large surface area to mate up against the outside of the tub 12. The seal/gasket 102 has an aperture 108 and fits onto a perimeter riser 110 of the elbow 14. In this way the seal 104 nests onto the elbow in a secure manner.

On the inside surface 152 of the tub 12 is installed a bracket 112. The bracket 112 has as a slot opening 114 and two countersunk holes 116*a* and 116*b*. Screws 118*a* and 118*b* are designed to nest within the bracket 112 such that the heads of the screws are at or below the top surface of the bracket 112. The screws 118 are then able to pass through the bracket, pass through holes drilled into the tub 12 and engage into holes 120*a* and 120*b* of the elbow 14.

Another seal/gasket 122 is formed that matches the backside of the bracket 112. The seal 122 also has a slot 124 and matching holes 126*a* and 126*b*. The seal 122 could be a separate part or could be made with adhesive backing. For instance the seal 122 could be preinstalled onto the gasket 112. Then the installer would simply have to peal off a backing layer and then push the bracket 112 and seal 122 onto the appropriate location.

One will notice that the bracket 112 has a plurality of compressible nubs 128 disposed about the perimeter 130 of the bracket 112. When the faceplate 100 is pressed onto the bracket 112, the nubs compress a slight amount and hold the faceplate 100 in place. FIG. 2A is a cross-sectional view taken along the lines 2A-2A from the structure of FIG. 1. Here, one can see that the faceplate 100 is shaped to overlap the bracket 112 such that the faceplate 100 is the only part visible once the installation is complete. This facilitates a simple and sleek appearance to the end user.

Figure 3:
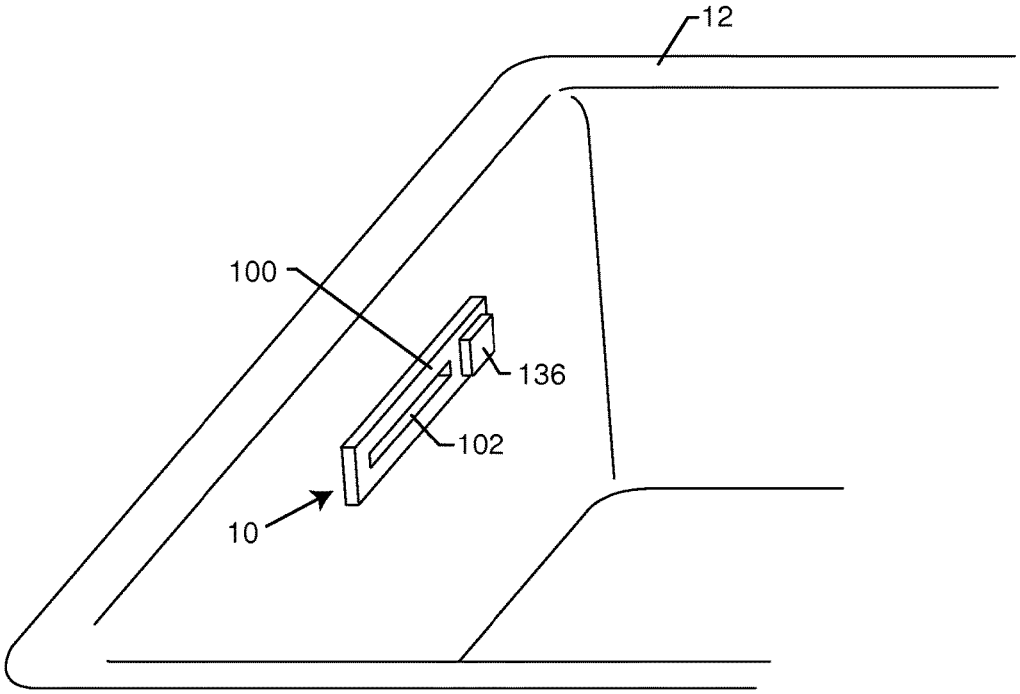
FIG. 3 is a perspective view similar to FIG. 1 now showing an overflow with an integrated knob for a bottom drain control.

One of the disadvantages of the embodiment described so far is that there is no longer a provision for closing the overflow closure device 10 as was taught in the '719 patent. FIG. 3 is a perspective view similar to FIG. 1 now showing an overflow device 10 with an integrated knob 136 for closing the slot 102. Closing of the slot 102 may be accomplished in many ways taught herein or combinations thereof.

Figure 4:
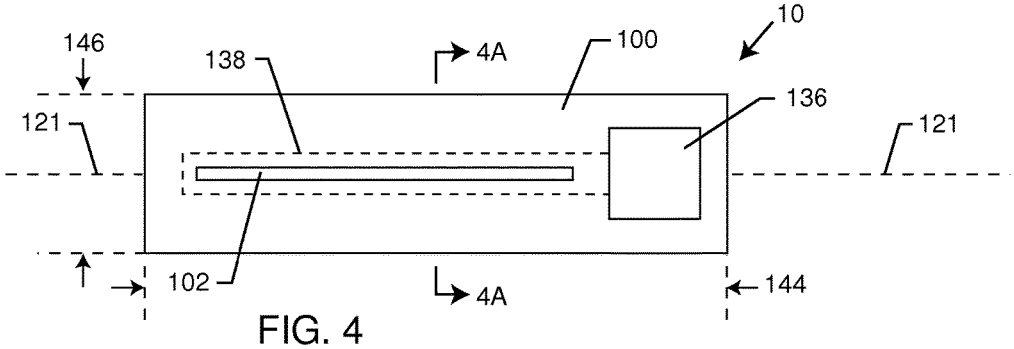
FIG. 4 is a front view of an exemplary overflow closure device.
Figure 4A:
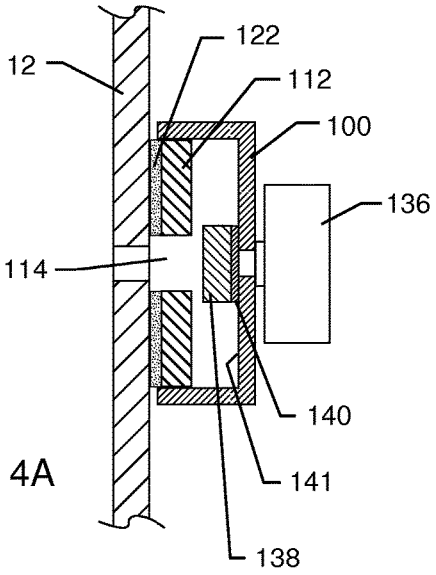
FIG. 4A is a cross-sectional view taken along lines 4A-4A from the structure of FIG. 4.

FIG. 4 is a front view of an exemplary overflow closure device 10 and FIG. 4A is a cross-sectional view taken along lines 4A-4A from the structure of FIG. 4. The knob 136 is connected to a seal plate 138. The seal plate 138 extends along the entire length of the slot 102. Optionally the seal plate 138 may have a seal/gasket 140 attached to its surface that touches the backside of the faceplate 100. The gasket 140 or the seal plate 138 presses up against the backside 141 of the faceplate 100. When the seal plate 138 is disposed overtop the slot 102 it seals the slot 102 such that water cannot pass through. The seal plate 138 is shown in dashed lines because it is behind the faceplate 100. The centerline 121 to the left is also shown in dashed lines.

Figure 4B:
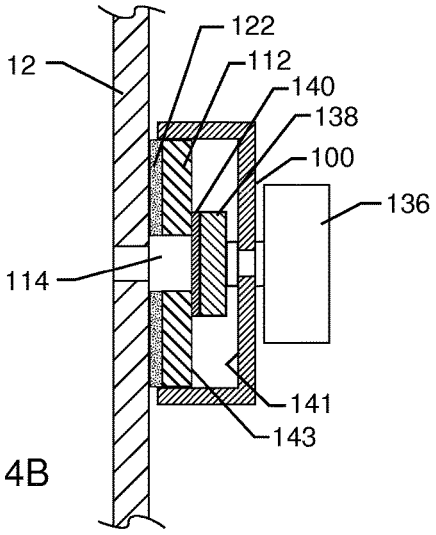
FIG. 4B is similar to FIG. 4A but now the seal plate seals against the front surface of the bracket.

FIG. 4B is similar to FIG. 4A but now the seal plate 138 seals against the front surface 143 of the bracket 112. As can be seen, there are many ways to seal or close either the slot 102 in the faceplate 100, the slot 114 in the bracket 112 or both at the same time.

Figure 5:
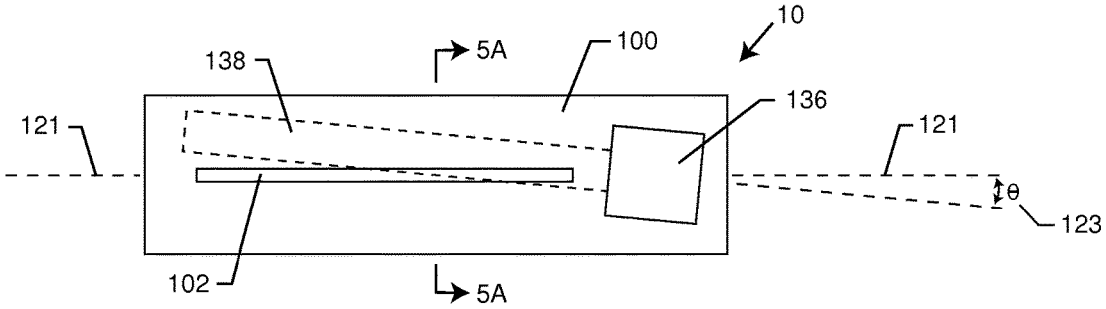
FIG. 5 is a front view of the exemplary overflow closure device of FIG. 4 now in the open position.
Figure 5A:
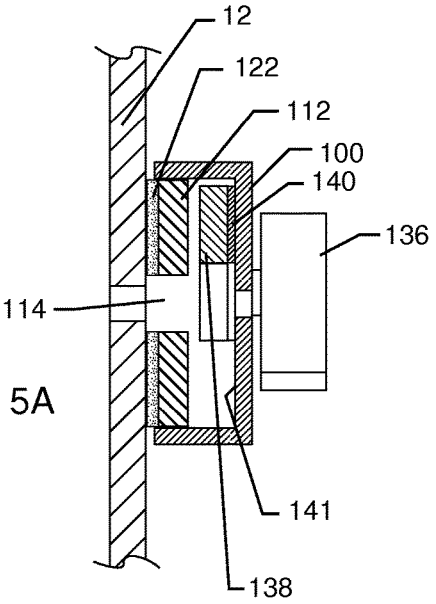
FIG. 5A is a cross-sectional view taken along lines 5A-5A from the structure of FIG. 5.

FIG. 5 is a front view of the exemplary overflow closure device of FIG. 4 now in the open position and FIG. 5A is a cross-sectional view taken along lines 5A-5A from the structure of FIG. 5. When the knob 136 is rotated, it causes the seal plate 138 to pivot away from the slot 102 at an angle 123. Then the slot 102 is open such that water can flow therethrough.

Figure 6:
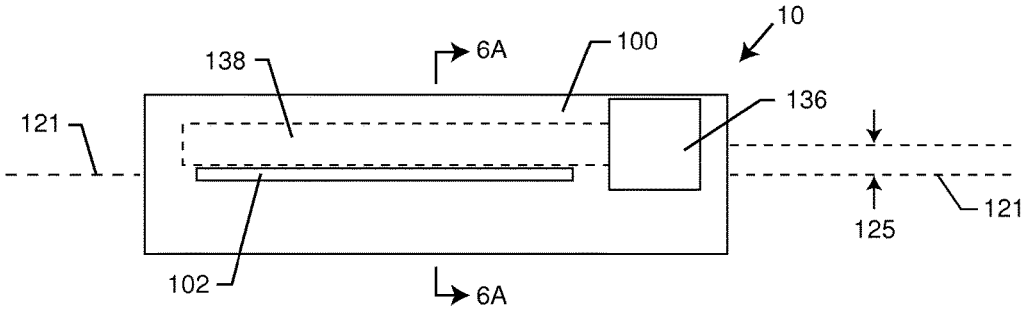
FIG. 6 is a front view of another exemplary overflow closure device.
Figure 6A:
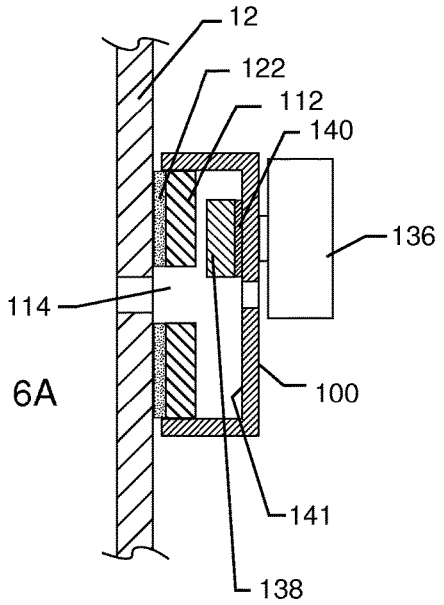
FIG. 6A is a cross-sectional view taken along lines 6A-6A from the structure of FIG. 6.

FIG. 6 is a front view of another exemplary overflow closure device and FIG. 6A is a cross-sectional view taken along lines 6A-6A from the structure of FIG. 6. In this embodiment, the knob 136 is configured not to pivot (as in FIG. 5) but now to translate upwards or downwards. A small movement 125 of the knob 136 completely allows the face plate 138 to slide above or below the slot 102 such that the slot 102 is completely open.

Figure 7:
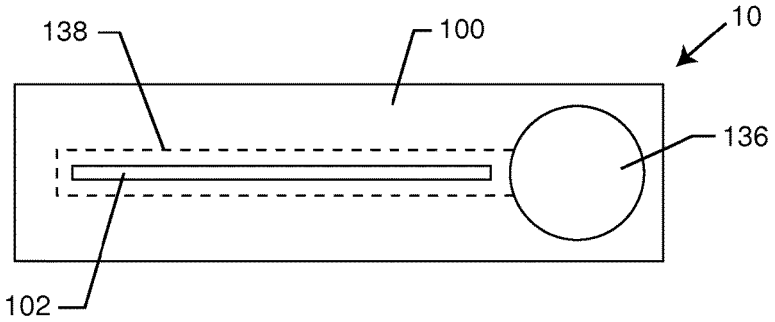
FIG. 7 is a front view of another exemplary overflow closure device similar to FIG. 4 now showing a round knob.

FIG. 7 is a front view of another exemplary overflow closure device 10 similar to FIG. 4 now showing a round knob 136. In the embodiments shown herein the knob 136 can be round, square, rectangular, triangular or any other geometric shape which one can grasp and turn or slide.

One of the disadvantages of the embodiments described so far is that there is not a provision for also controlling the bottom drain 132. Skipping ahead to FIG. 9, once can see that a bottom drain 132 can be controlled manually through a cable 134. The cable 134 is then attached to a point at or near the overflow device 10. This allows a user to open or close the drain 132 without having to bend further over into the tub 12 or reach down into hot or cold water that may already be present in the tub.

Figure 8:
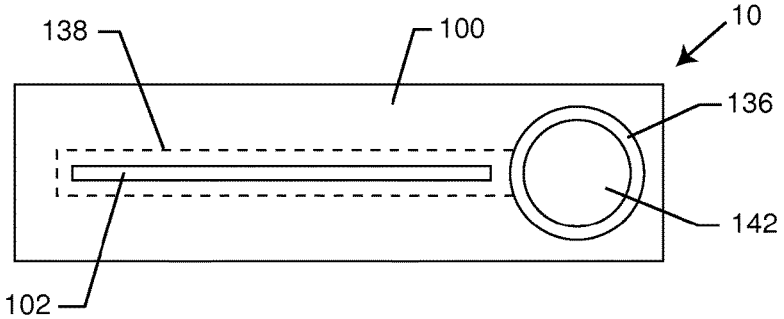
FIG. 8 is a front view of another exemplary overflow closure device now showing two knobs for controlling separate features.
Figure 8A:
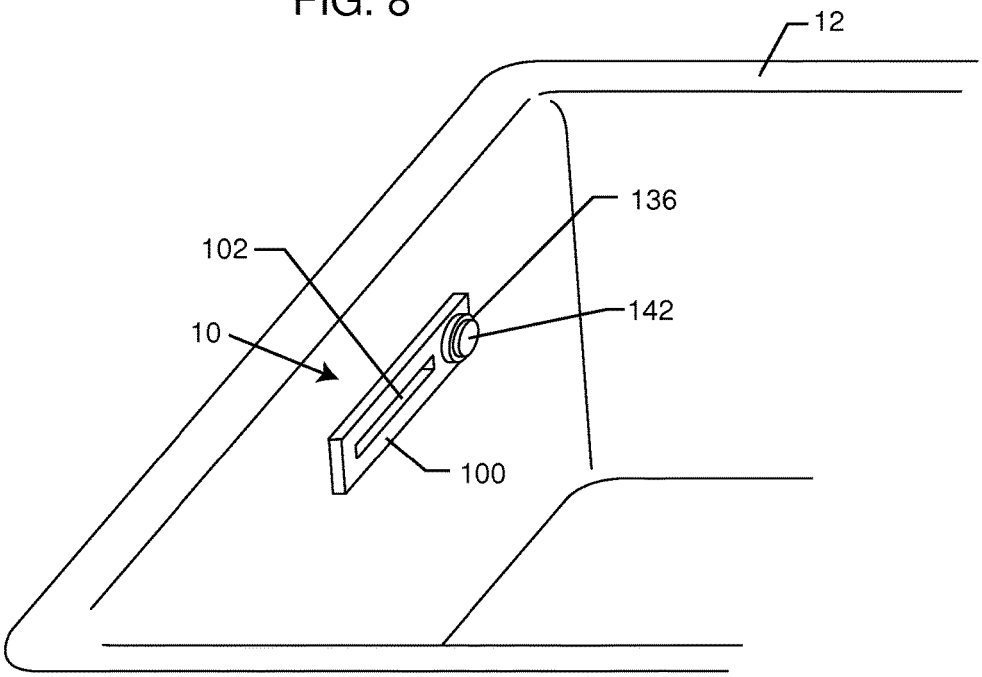
FIG. 8A is a perspective view of the structure of FIG. 8.
Figure 9:
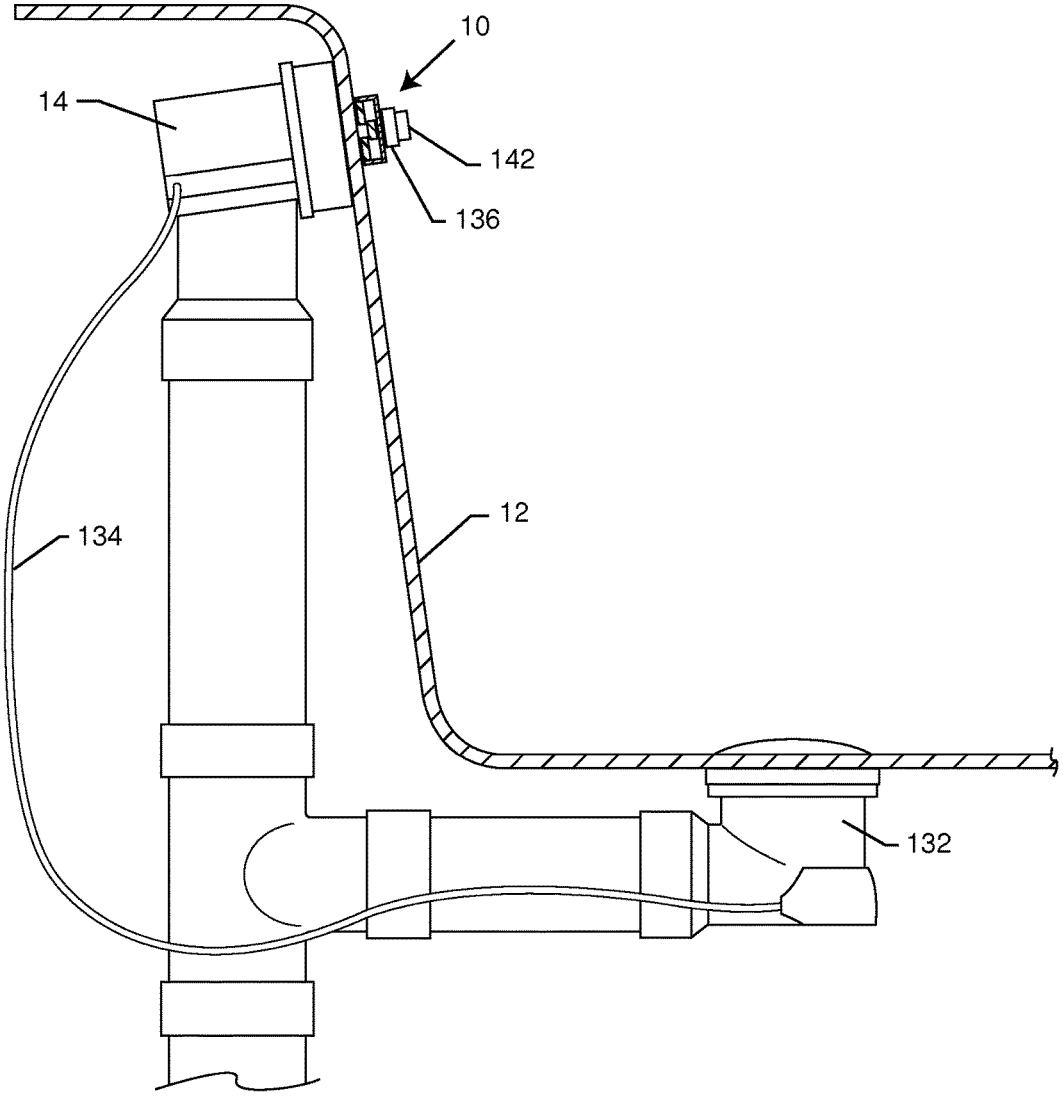
FIG. 9 is a side view of an exemplary drain closure device.

FIGS. 8, 8A and 9 show an overflow device 10 with an integrated knob 136 for closing the slots and now another knob 142 for controlling the bottom drain 134. The knob 142 is coupled to the cable 134 that then leads to the bottom drain 132. A user can then rotate/turn the knob 142 and activate the bottom drain 132. Here, the knobs 136 and 142 are aligned along the same axis. This means the knobs are concentric with one another or are aligned with one another along the same axis of rotation or pivot. It is also apparent that the functionality of the knobs can also be reversed where the front knob closes the slot 102 and the rear knob opens or closes the bottom drain 132. Furthermore, the knobs may take any shape or design as earlier discussed. With this embodiment, the sleek and simplistic design aesthetics are kept while providing advanced functionality of closing the upper drain slot 102 and now the lower drain 132.

Figure 10:
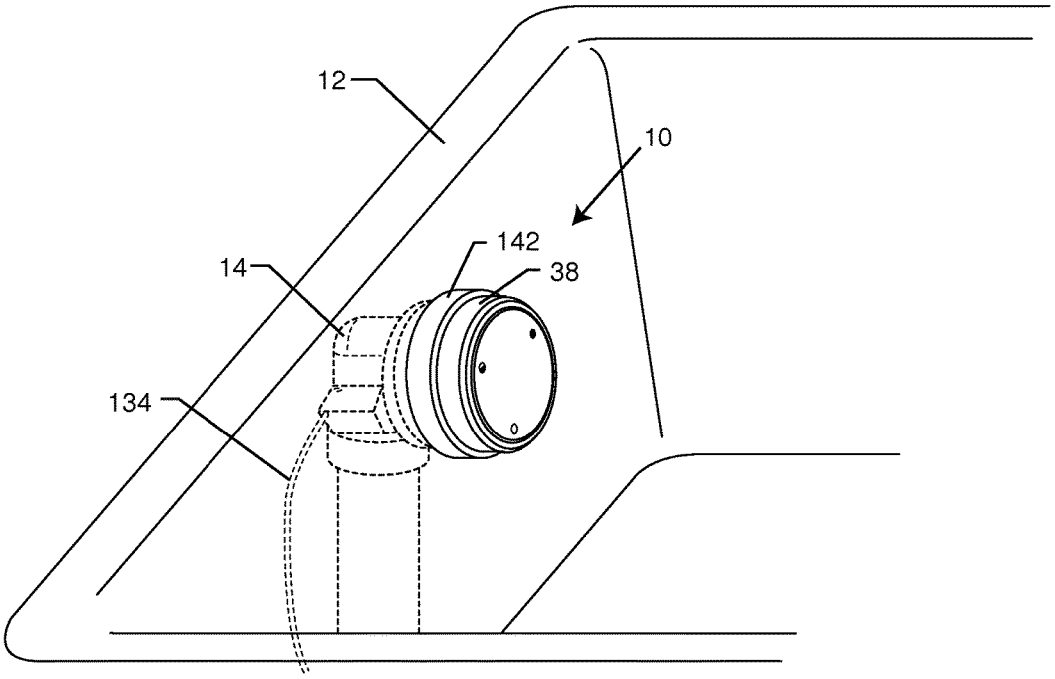
FIG. 10 is a perspective view of an exemplary adjustable overflow closure device now showing two knobs.
Figure 11:
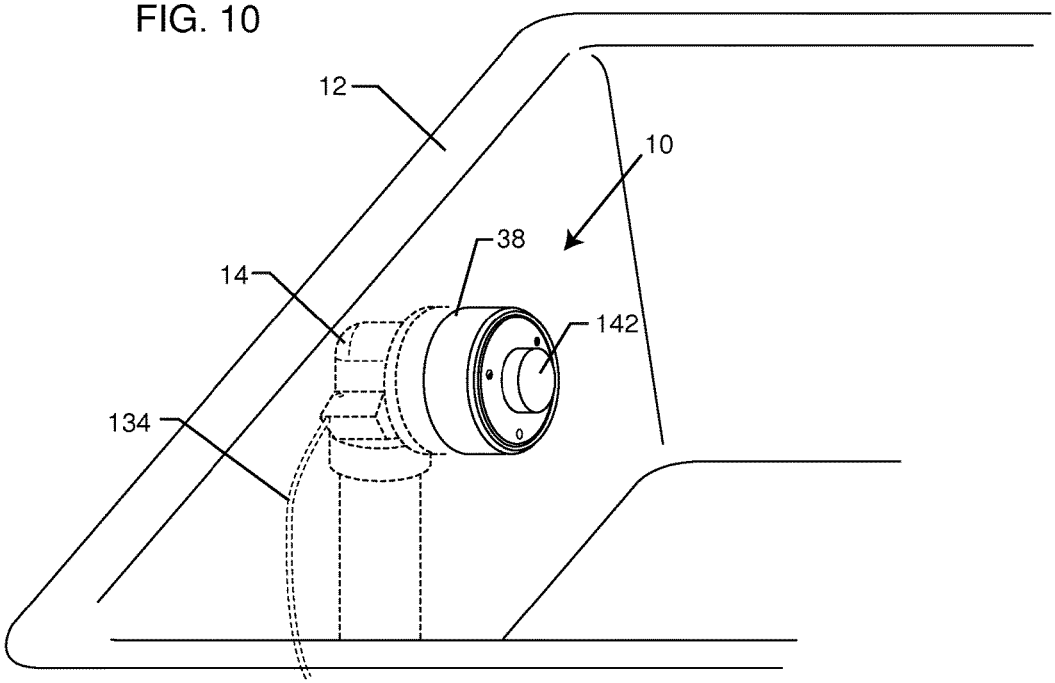
FIG. 11 is a perspective view of another exemplary adjustable overflow closure device similar to FIG. 10 but now showing two knobs in a different size and orientation.

FIG. 10 is a perspective view of an exemplary adjustable overflow closure device 10 from the '719 patent now with the drain closure knob 142. All of the features of the '719 patent are incorporated herein, but now the second knob 142 can open or close the bottom drain 132 through the cable 134. In this embodiment the second knob 142 is behind the first knob 38 from the '719 patent. Alternatively, FIG. 11 is a perspective view of another exemplary adjustable overflow closure device 10 similar to FIG. 10 but now showing the second knob 142 ahead of the knob 38. While the knobs 38 and 142 are concentric and rotate about a common axis, either can be configured to reside ahead of or behind the other. In this way, the structure of the '719 patent can have added functionality while still keeping its simplistic and sleek design.

Although several embodiments have been described in detail for purposes of illustration, various modifications may be made to each without departing from the scope and spirit of the invention. Accordingly, the invention is not to be limited, except as by the appended claims.

What is claimed is:

1. An overflow drain for a tub, comprising:

a bracket longer in dimension in a horizontal direction as compared to a vertical direction, wherein the bracket is configured to be located against an inside surface of the tub and connected to an overflow elbow on an outside surface of the tub;

a first elongated slot disposed through the bracket along the horizontal direction;

at least two fastener holes disposed within the bracket;

a faceplate longer in dimension in the horizontal direction as compared to the vertical direction, wherein the faceplate is configured to be attached to the bracket and the faceplate is stationary in relation to the bracket;

a second elongated slot disposed through the faceplate along the horizontal direction;

a first knob connected to the faceplate and movable in relation to the faceplate, wherein the first knob is disposed on an outside of the faceplate;

an elongated seal plate disposed on an inside of the faceplate, the seal plate connected to the first knob and non-movable in relation to the first knob, wherein the seal plate is configured to move between an open position and a closed position by a movement of the first knob, wherein in the closed position the seal plate is configured to create a watertight seal around either the first or second elongated slots, and wherein in the open position the seal plate is configured to drain a fluid through the first and second elongated slots.

2. The overflow drain of claim 1, wherein the bracket is rectangular-shaped.

3. The overflow drain of claim 2, wherein the at least two fastener holes are countersunk.

4. The overflow drain of claim 3, wherein the faceplate is rectangular-shaped.

5. The overflow drain of claim 1, wherein the first knob is pivotably connected to the faceplate.

6. The overflow drain of claim 1, wherein the first knob is translatably connected to the faceplate.

7. The overflow drain of claim 1, wherein the first knob is circular-shaped, square-shaped, rectangular-shaped or triangular-shaped.

8. The overflow drain of claim 1, including a second knob connected to the faceplate disposed on the outside of the faceplate, wherein the second knob is disposed either behind or ahead of the first knob.

9. The overflow drain of claim 8, wherein the second knob is connected to a movable cable at a first cable end, wherein a second cable end is connected to a bottom drain.

10. The overflow drain of claim 9, wherein bottom drain is configured to move between an open position and a closed position by a movement of the second knob, wherein in the closed position the bottom drain is configured to create a watertight seal, and wherein in the open position the bottom drain is configured to drain the fluid.

11. The overflow drain of claim 1, including a seal or gasket disposed between the bracket and the inside surface of the tub.

12. The overflow drain of claim 11, wherein the seal or gasket includes an adhesive backing.

13. The overflow drain of claim 1, including a seal or gasket attached to the elongated seal plate.

14. The overflow drain of claim 13, wherein the seal or gasket is configured to seal either the first or second elongated slots when the seal plate is in the closed position.

15. An overflow drain for a tub, comprising:

a bracket longer in dimension in a horizontal direction as compared to a vertical direction, wherein the bracket is configured to be located against an inside surface of the tub and connected to an overflow elbow on an outside surface of the tub;

a first elongated slot disposed through the bracket along the horizontal direction;

at least two fastener holes disposed within the bracket;

a faceplate longer in dimension in the horizontal direction as compared to the vertical direction, wherein the faceplate is configured to be attached to the bracket and is stationary in relation to the bracket;

a second elongated slot disposed through the faceplate along the horizontal direction;

a first knob connected to the faceplate and pivotable in relation to the faceplate, wherein the first knob is disposed on an outside of the faceplate;

an elongated seal plate disposed on an inside of the faceplate, the seal plate connected to the first knob and non-movable in relation to the first knob, wherein the seal plate is configured to move between an open position and a closed position by a movement of the first knob, wherein in the closed position the seal plate is configured to create a watertight seal around either the first or second elongated slots, and wherein in the open position the seal plate is configured to drain a fluid through the first and second elongated slots;

a second knob connected to the faceplate and pivotable in relation to the faceplate, wherein the second knob is disposed on the outside of the faceplate, wherein the second knob is disposed either behind or ahead of the first knob;

wherein the second knob is connected to a movable cable at a first cable end, wherein a second cable end is connected to a bottom drain in a bottom of the tub;

wherein bottom drain is configured to move between an open position and a closed position by a movement of the second knob, wherein in the closed position the bottom drain is configured to create a watertight seal, and wherein in the open position the bottom drain is configured to drain the fluid.

16. The overflow drain of claim 15, wherein the bracket and the faceplate are both rectangular-shaped.

17. The overflow drain of claim 15, wherein the at least two fastener holes are countersunk.

18. The overflow drain of claim 15, including a seal or gasket attached to the elongated seal plate.

19. The overflow drain of claim 18, wherein the seal or gasket is configured to seal either the first or second elongated slots when the seal plate is in the closed position.

* * * * *